US005671759A

United States Patent [19]

Chung et al.

[11] Patent Number: 5,671,759

[45] Date of Patent: Sep. 30, 1997

[54] DEVICE FOR WRAPPING HAIR WITH CORD

[75] Inventors: Caleb Chung, 3460 Plantation River Dr., Boise, Id. 83703; David M. Snively; Joseph C. Beck, both of Cincinnati, Ohio

[73] Assignee: Caleb Chung, Boise, Id.

[21] Appl. No.: 625,723

[22] Filed: Mar. 29, 1996

[51] Int. Cl.[6] ..... A45D 20/08

[52] U.S. Cl. ..... 132/271; 132/212; 57/1 R; 242/390.8

[58] Field of Search ..... 132/271, 212, 132/273; 57/1 R; 242/390.8, 405, 407

[56] References Cited

U.S. PATENT DOCUMENTS

| | | | |
|---|---|---|---|
| 1,048,687 | 12/1912 | Goodrick . | |
| 1,927,261 | 9/1933 | Evans . | |
| 2,792,775 | 5/1957 | Beyette . | |
| 4,038,996 | 8/1977 | Eronini et al. | 132/271 |
| 4,580,585 | 4/1986 | Sapkus | 132/212 |
| 4,583,561 | 4/1986 | Larson | 132/212 |
| 4,824,036 | 4/1989 | Buta | 132/212 |
| 5,488,963 | 2/1996 | Fishman | 132/212 |

FOREIGN PATENT DOCUMENTS

| | | |
|---|---|---|
| 439219 | 5/1913 | France . |
| 239659 | 9/1925 | United Kingdom . |

*Primary Examiner*—Gene Mancene
*Assistant Examiner*—Philogene Pedro
*Attorney, Agent, or Firm*—Marshall, O'Toole, Gerstein, Murray & Borun

[57] ABSTRACT

A toy hair wrapping device is disclosed. The device includes a housing for supporting a rotating spindle, a spool, and a motor for rotating the spindle. As the spindle rotates, cord on the spool is dispensed and wrapped around hair in the spindle bore. If the cord becomes unduly tensioned the device will release the cord from the rotating spindle to prevent pulling of the hair or snapping of the cord.

16 Claims, 3 Drawing Sheets

FIG.4
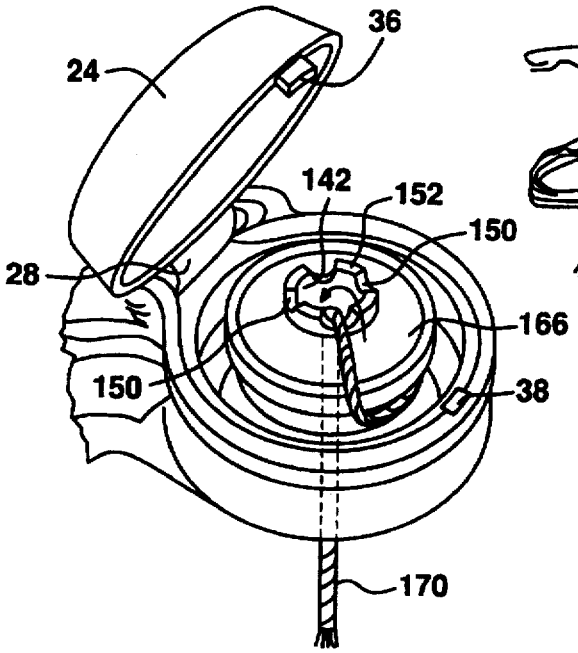
FIG.5
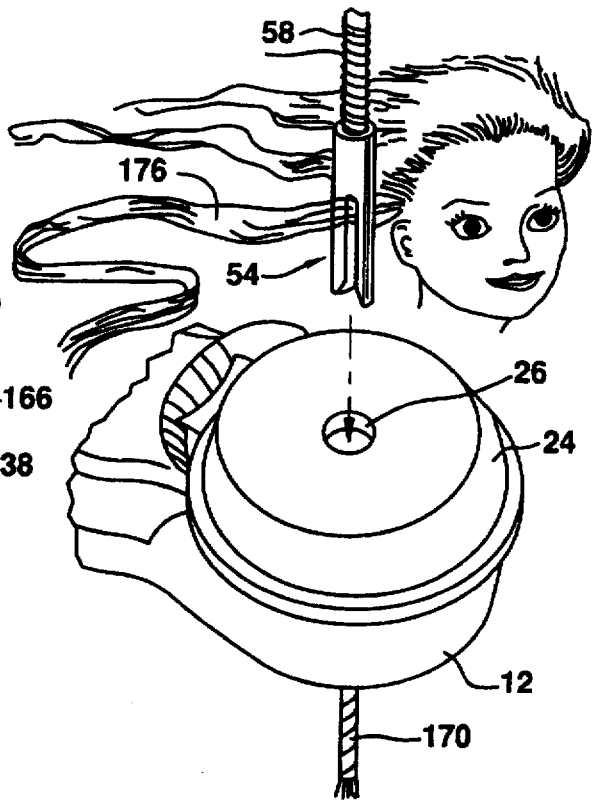
FIG.6
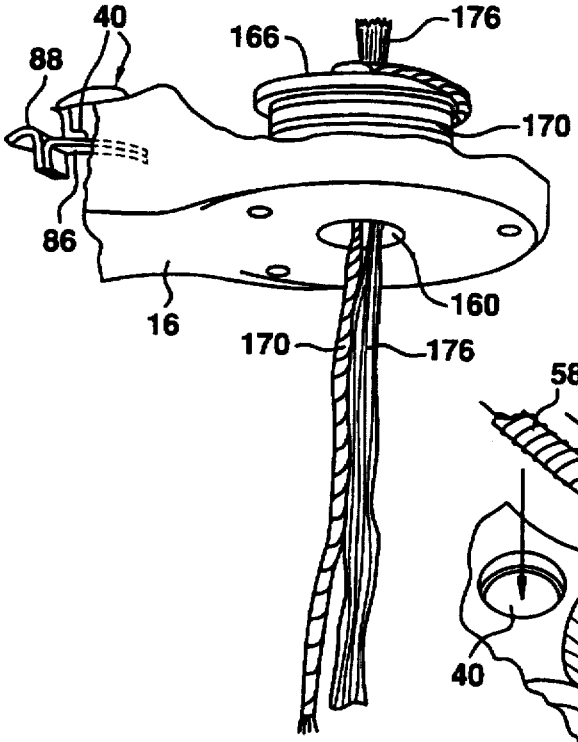
FIG.8
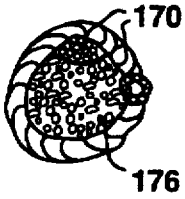
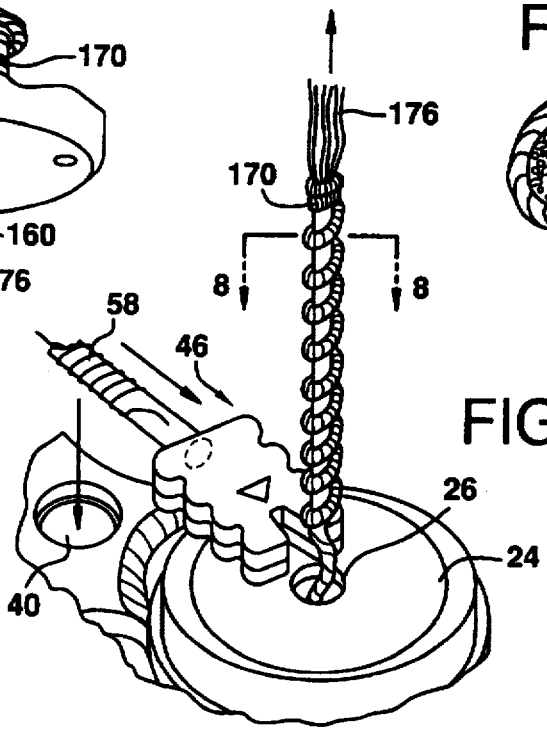
FIG.7

DEVICE FOR WRAPPING HAIR WITH CORD

FIELD OF THE INVENTION

This invention relates generally to a device for wrapping hair with cord, and particularly to a hand-held device that wraps hair with cord as an adornment.

BACKGROUND OF THE INVENTION

Hair wrapping devices are known which wrap cords around locks of hair. Buta, U.S. Pat. No. 4,824,036, discloses a device wherein a lock of hair is passed through a tubular housing so that a wrapping cord contained on a tubular spool in the housing is wrapped around the hair when a motor is energized. The Buta device is complicated to build and operate because it includes many parts, has small cord guide openings, and is subject to vibration due to an off-center spool-mounting arrangement. Further, the Buta device has no safety means for stopping the winding process should the cord be tangled or unduly tensioned before the motor stops.

Thus, a device is needed that is simple, compact, and inexpensive to build and operate, and also adds a level of safety by limiting the amount of tension that can be applied to the cord. The present invention satisfies these objectives.

SUMMARY OF THE INVENTION

A hair wrapping device in accordance with the present invention, is simple to build and operate, has low vibration, and includes a hair feeding device that feeds hair and wrapping cord into the apparatus quickly and easily. The device is constructed in a manner that will not pull hair, wrap hair too tightly, or unduly tension the wrapping cord.

Such an apparatus includes: a housing; a spindle operatively joined to the housing and defining a spindle bore for receiving cord and hair, and defining a detent for receiving cord; a spool defining a spool bore through which the spindle is disposed, and for receiving and dispensing cord; and means for rotating the spindle relative to the housing and the spool; whereby cord is dispensed from the spool through the detent and the spindle bore, hair is disposed in the spindle bore, and the spindle is rotated to wrap the hair with cord.

The device is preferably easily held in one hand by providing a housing having a hollow handle and; defining a hollow chamber; a spindle is disposed in the hollow chamber and rotatably joined to the housing, the spindle defining a spindle bore for receiving cord and hair, and having one end defining a plurality of cord retaining detents; a spool for receiving and dispensing cord, the spool defining a spool bore through which the spindle is disposed; a spool cover hinged to the housing for maintaining the spool in the hollow chamber and for maintaining the cord in one of the spindle detents; a motor disposed in the hollow handle and having a rotating shaft; a gear mesh for transmitting rotary motion from the motor shaft to the spindle and spindle detents; whereby the spindle and spindle detents are rotated around the hair in the spindle bore and the hair is wrapped with cord.

The hair wrapping device may include means for releasing the cord from the spindle when tension in the cord becomes excessive. The means for releasing the cord may include a cover spaced apart from the end of the spindle a dimension less than the diameter of the cord. Alternatively, the means may include a spool that is adjustably friction-fit to the spindle so that the spool will rotate relative to the spindle when undue tension is applied to the cord.

To enable easy feeding of hair through the spindle bore, a bifurcated wand for grasping and feeding hair through the spindle bore can be provided.

The gear mesh for rotating the spindle may include a worm gear fixed to the motor shaft, a worm gear follower meshed with the worm gear, a spur gear fixed coaxially with the worm gear follower, an idler gear meshed with the spur gear, and a drum gear meshed with the idler gear and fixed to the spindle.

BRIEF DESCRIPTION OF THE DRAWINGS

FIG. 4 is a partial perspective view of the hair wrapping device of FIG. 1 with the spool cover open and cord passing through a spindle detent and a spindle bore;

FIG. 5 is the partial perspective view of the portion of the device as depicted in FIG. 4 with the spool cover closed and a lock of hair positioned in the bifurcated tool for being inserted into the spindle bore;

FIG. 6 is a partial perspective view illustrating hair and cord disposed in the spindle bore;

FIG. 7 is a partial perspective view of the hair wrapping device with a lock of hair wrapped by cord and the tool in position to cut the cord;

FIG. 8 is a cross-sectional view of hair and cord taken along line 8—8 in FIG. 7.

DETAILED DESCRIPTION OF THE DRAWINGS

To the extent practical, the same or similar elements will be identified by the same numeral in each figure.

Figure 1:
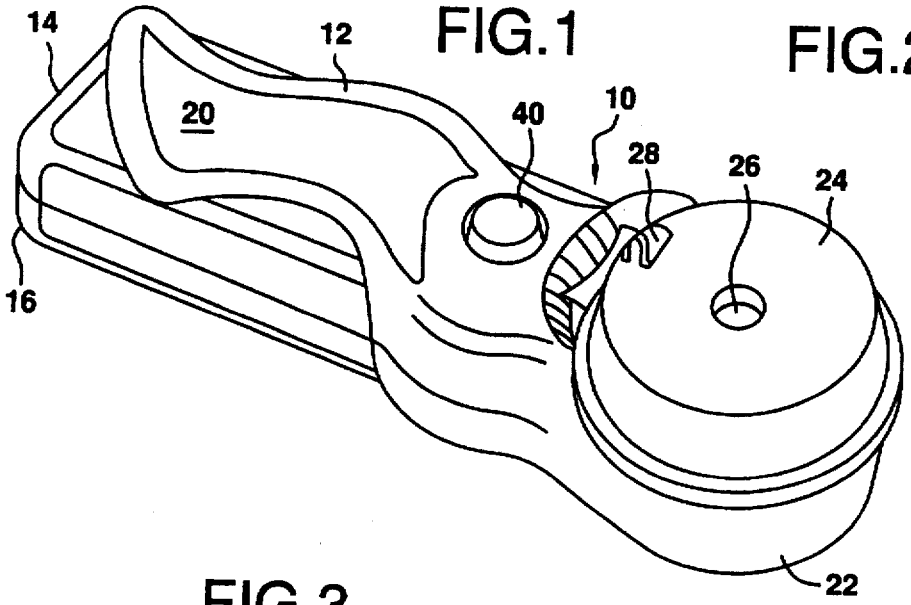
FIG. 1 is a perspective view of a hair wrapping device in accordance with the present invention.

In FIG. 1 there is illustrated a hair wrapping device 10 in accordance with the present invention which includes a housing 12 formed of an upper half 14 and a lower half 16. The housing 12 is shaped to provide a handle 20 on the left, preferably including a molded surface to make it easy to grip, as illustrated, and it may include any other designs to enhance play value. On the right, the housing 12 defines a barrel-shaped operative end 22 that includes a spool cover 24 defining a round opening 26.

Preferably, the spool cover 24 is clear or translucent so that the hair wrapping operation is visible therethrough. Further, although depicted as substantially flat, the spool cover 24 can be in a frustro-conical or other shape.

Figure 3:
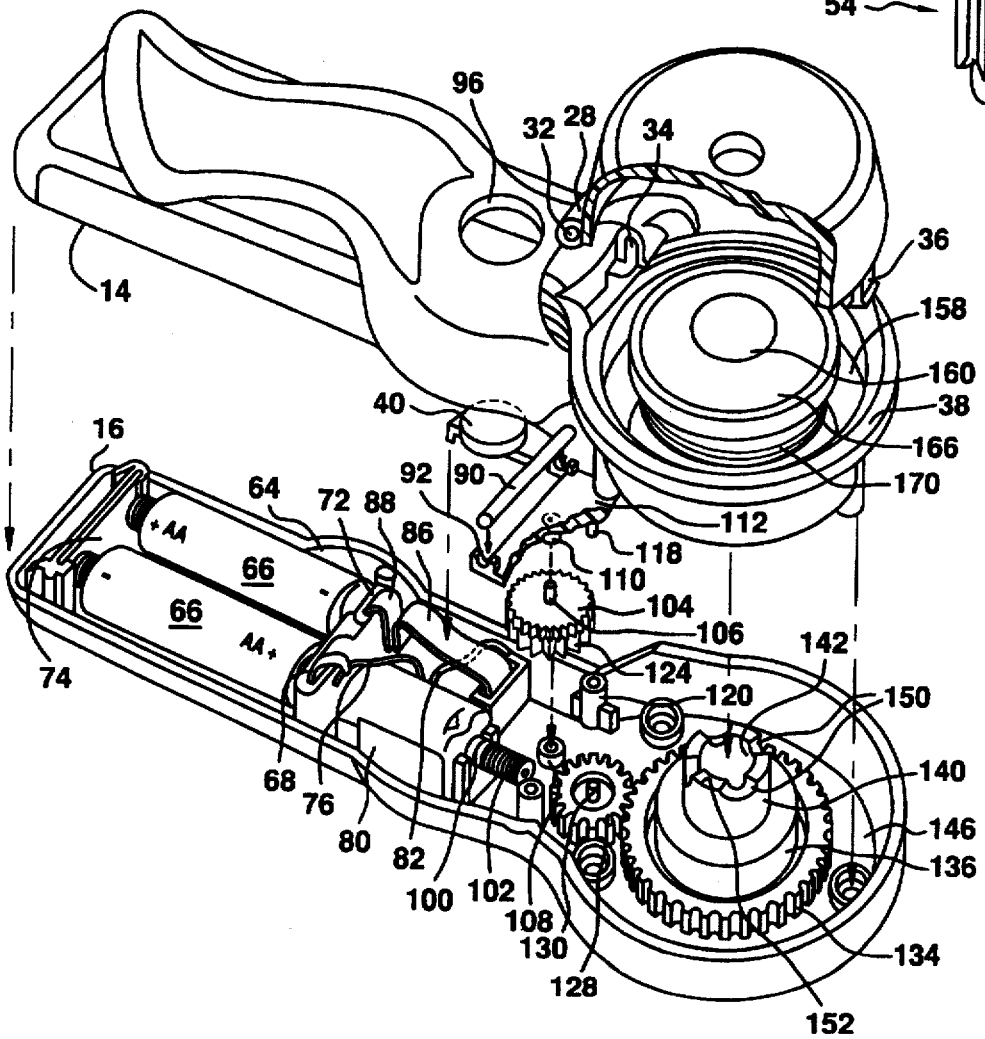
FIG. 3 is an exploded perspective view of the hair wrapping device of FIG. 1.

As illustrated in FIG. 3, the spool cover 24 is pivotally joined to the housing 12 by a hinge 28 that includes a pin 32 that extends outwardly beyond both ends of the hinge 28 to engage bearings 34 molded in the housing 12. A male snap element 36 is molded at the free end of the spool cover 24, and is shaped to engage a female snap element 38 formed in the operative end 22.

Also illustrated in FIG. 1 is a button 40 to activate the hair wrapping device 10 in a manner described in detail below.

Figure 2:
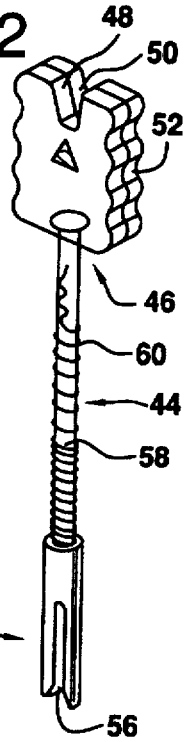
FIG. 2 is a bifurcated tool in accordance with the present invention for feeding hair through the hair wrapping device and cutting cord.

In FIG. 2 there is depicted a tool 44 having two ends. On the upper end is an optional bifurcated cutting device 46 including a tapered guide 48 and an angularly disposed razor 50, for cutting cord at the completion of a hair wrapping operation. The tapered guide 48 is narrow enough and long enough to prevent fingers from being cut on the razor 50 while providing ample room for cord to be inserted and cut by the razor 50. The sides of the cutting device 46 include ridges 52 that act as grips.

At the lower end of the tool 44 is a bifurcated hair feeding tool 54 which includes a slot 56 for receiving and holding hair and cord while the ridges 52 are gripped. The hair feeding tool 54 is inserted through the hair wrapping device as best illustrated in FIG. 5. Between the two ends of the tool 44 is a shaft 58 that is long enough to extend through the hair wrapping device 10 and includes an optional integrally molded line 60 "wrapped" around the shaft 58 as a design.

Referring to FIG. 3, the hair wrapping device 10 is illustrated in an exploded view so that the housing 12 is clearly split with the upper half 14 and lower half 16 of the housing 12 spaced apart. As is now apparent, the handle 20 defines a hollow space 64 containing two AA size batteries 66 integrated into an electrical circuit by a positive contact 68, a negative contact 72, and a jumper contact 74.

A wire lead 76 is joined to one positive contact and to a motor 80. Another wire lead 82 is connected to the motor 80 and to a button switch 86 made of resilient electrically conductive material. In the normal condition, the button switch 86 is up and spaced apart from a stationary contact 88 so that the circuit is open and the motor 80 is not energized. The stationary contact 88 is connected to the negative contact 72.

The button contact 86 can be pushed down by the button 40 which is preferably made of an insulating material and molded integrally with a pivot member 90 that rests in bearings 92. The button 40 is biased upward by the resilient button contact 86 in the normal condition. When pushed, the button 40 urges the resilient button contact 86 downward into electrical contact with the stationary contact 88 to close the circuit and energize the motor 80. The button 40 is accessible through a hole 96 defined by the housing 12, preferably near the front of the handle 20 for easy access by a thumb.

The motor 80 can be Mabuchi model FA-260RA, RE-260RA, RE-140RA or FA-130RA, or other suitable model. Further, the motor 80 may be powered by one or more batteries, or it may be powered interchangeably by one and two batteries to provide variable speed in the wrapping operation. A rocker switch can be used to dictate which of the two battery-powered modes will be used.

The motor 80, includes a shaft 100 that rotates when the motor 80 is energized. Fixed to the shaft 100 for rotation therewith is a worm gear 102. Meshed with the worm gear 102 is a worm gear follower 104 that spins on a gear shaft 106 that is rotatably fitted into a lower bearing 108 in the housing lower half 16. The upper end of the gear shaft 106 rides in an upper bearing 110 molded integrally into a plate 112 that also includes the bearings 92 for the button pivot member 90. Two downwardly extending pins 118 (only one is illustrated) hold the plate 112 securely in place by nesting is sockets 120 when the housing upper half 14 is secured to the lower half 16.

Referring back to the gear shaft 106, there also is a spur gear 124 fixed to the shaft 106 beneath the worm gear follower 104 for rotational movement therewith. An idler gear 128 is meshed with the spur gear 124 and rotationally mounted in the housing 12 using a shaft 130 and bearings (not illustrated). Meshed to the idler gear 128, is a drum gear 134 that is rotatably mounted to the lower housing half 16 and molded integrally with a drum 136. Alternative gear mesh arrangements could be used to transmit the rotary motion from the motor to the spindle, which one skilled in the art will appreciate. Further, a gear mesh can be used which incorporates a belt-drive which can reduce vibration, reduce noise, and provide a clutching mechanism which will slip when the spindle is restrained from rotating.

Molded integrally with and extending upward from the drum gear 134 is a reduced portion or spindle 140. The spindle 140 defines a bore 142 that extends between the top and bottom of a hollow chamber 146 in the housing 12. At the end of the spindle 140 there are defined a plurality of detents 150 separated by a plurality of flats 152 that can be painted for easy identification through a translucent spool cover 24.

The drum 136 and the spindle 140 extend upward through a hole 154 (not illustrated) in the upper housing half 14 and into a hollow spool chamber 158 defined by the upper housing half 14. The spindle bore 142 aligns with the spool cover hole 26 and a spindle hole 161 in the lower housing half 16. In this manner, hair can be threaded through the housing 12 from top to bottom. The spindle 140 may include a threaded cap to be adjustable in length and alter the spacing between the end of the spindle 140 and the spool cover 24. The threaded cap is rotated by hand to make the gap spacing adjustment. This spacing can provide the cord 170 with a means for being released from the spindle 140 should the cord be unduly tensioned as described in more detail below.

Disposed in the hollow spool chamber 158 is a replaceable spool 166 defining a spool bore 168 sized so that the spindle 140 can slide and rotate therein. Further, coaxial alignment of the spindle 140 and the spool 166 is maintained by the drum 136 extending upward into a matching annular recess (not illustrated) in the bottom of the spool 166. In the illustrated embodiment, the spool 166 is freely rotatable around the spindle 140 to unwind cord as needed and without resistance.

Figure 9:
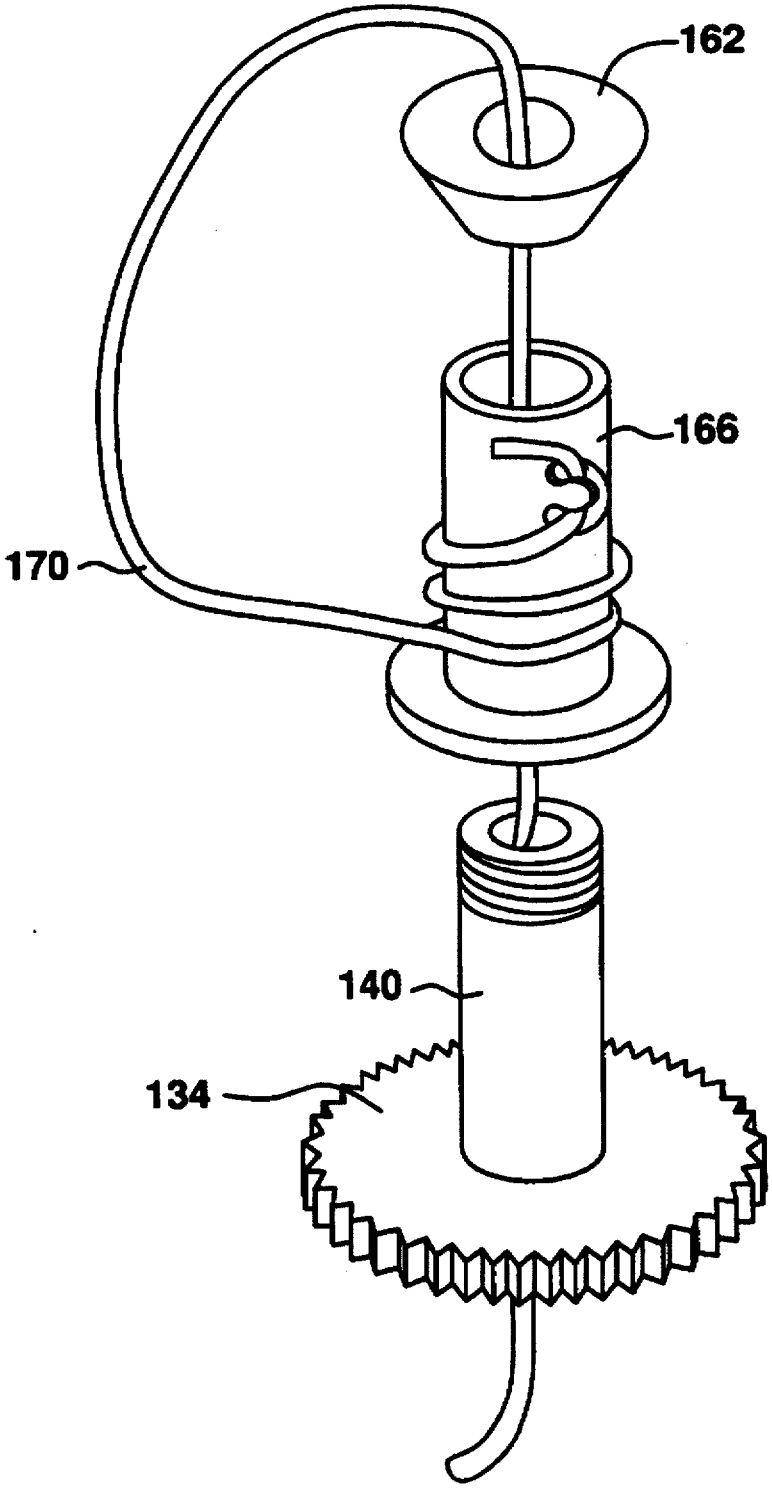
FIG. 9 is a partial perspective view of an adjustable-friction spindle.

Alternatively, the spool 166 can be friction fit over the spindle 140 so that a greater degree of tension in the cord 170 is necessary to spin the spool 166 on the spindle 140 to dispense cord. The friction fit is desirable because it introduces a tension to the cord 170 and if the tension becomes excessive, the spool 166 will simply spin on the spindle 140 rather than continuing to rotate and introduce greater cord tension that can pull or damage hair or snap the cord. Further, when the spool 166 is friction fit it is possible to use a spindle 140 without detents, as illustrated in FIG. 9, because the spool 166 will spin the cord 170 around the hair. The amount of friction between the spool 166 and the spindle 140 can be varied by rotating the threaded cap 162 to tighten or loosen the spool 166.

The spool 166 is adapted for receiving and dispensing cord 170 which is defined as including thread, yarn, string, and other flexible elongated material used to adorn hair. A number of spools 166 may be used interchangeably so that a variety of cord colors and textures are ready as desired. Further, to make winding the cord 170 onto the spool 166 easier, a slot (not illustrated) in the housing 22 may be used to feed cord onto a spool 166 mounted on the spindle 140 by rotating a friction-fit spool 166.

As described to this point, it should be apparent that the spool 166 is loaded into the hair wrapping device 10 by snapping open the spool cover 24 to expose the hollow spool chamber 158, the spindle 140, and the drum 136. The spool 166 is dropped into the spool chamber 158 over the spindle 140 and the drum 136.

An end of the cord 170 is pulled into a detent 150, fed down through the spindle bore 142, and out of the spindle hole 160 in the bottom of the housing 12. By simply closing the spool cover 24 and snapping it down, the spool 166 will be confined to rotational movement on the drum 136. Also, by closing the spool cover 24, the cord 170 is detained in the detent 150 because the spool cover 24 is spaced apart from the end of the spindle a distance that is smaller than the diameter of the cord 170. For example, using a standard cord of five-strand embroidery floss having an average approximate diameter of about 0.012 to 0.015 inches, the space between the spool cover 24 and the spindle flats 152 can be about 0.007 to 0.010 inches. Further, with this arrangement the user of the device does not have to feed the cord 170 through any small guideways and no other special skills are necessary to feed the cord 170 or set up the spool 166 prior to wrapping hair.

After the cord 170 is fed through the spindle bore 142, a lock of hair 176 to be wrapped is inserted in the slot 56 on the bifurcated hair feeding tool 54. The tool 54 is then pushed down through the spindle bore 142 along side the cord 170. By simply sliding the hair out 176 of the slot 56, the tool 54 can be withdrawn from the spindle bore 142.

Alternatively, the cord 170 can be pulled through a detent 150 and out of the spool cover hole 26. Then the hair 176 and cord 170 can be fed together down through the spindle bore 142 with the tool 54.

By pushing the button 40, the electrical circuit is closed and the motor 80 is energized to rotate the spindle 140 through the gear mesh. When the spindle 140 rotates, the detents 150 rotate, as well, to dispense the cord 170 from the spool 166 and wrap the hair with the cord 170. As the cord 170 is being wrapped around the hair, it is desirable to pull the hair out of the spindle bore 142 slowly so that the hair is wrapped along the desired length. Further, slow pulling will result in a closer wrap than a quicker pull.

Because there is a gap between the spool cover 24 and the end of the spindle 140, the cord 170 will be retained in the detent 150 unless the cord 170 becomes abnormally tensioned due to the cord becoming knotted or tangled. If this occurs and the motor is not stopped by the operator, the tension will elongate the cord 170 and reduce its diameter until the cord 170 is able to slip through the space between the spool cover 24 and the spindle flats 152 and, therefore, not introduce any additional tension that might pull hair or break the cord. The cord 170 will continue to slip through gap until the tangle is worked out or the user stops the motor 80. As stated above, the gap can be variable by using a threaded cap, for example, that is rotated to move up or down relative to the spool cover 24 (not illustrated).

When the hair 176 is wrapped to the desired amount and appearance, the hair 176 is pulled out of the spindle bore 142 completely and the cord 170 is cut with scissors or by sliding the cord 170 into the cutting device's 46 tapered guides 48 and against the razor 50. The ends of the cord 170 may be tied, clipped, or beaded together to ornamentally secure the wrapping or another color or texture of cord can be wrapped on and tied to the previously wrapped cord.

The foregoing detailed description is provided for clearness of understanding only, and no unnecessary limitations should be read therefrom into the claims herein.

What is claimed is:

1. Apparatus for wrapping hair with a cord, comprising:

a housing;

a spindle operatively joined to the housing, and defining a spindle bore for receiving cord and hair, and having an end defining a detent for receiving cord;

means for retaining the cord in the detent;

a spool defining a spool bore through which the spindle is disposed, and the spool is for receiving and dispensing cord; and means for rotating the spindle relative to the housing;

whereby cord is dispensed from the spool through the detent and spindle bore, hair is disposed through the spindle bore, and the spindle is rotated to wrap the hair with cord.

2. The apparatus of claim 1 in which the means for retaining the cord in the detent comprises a spool cover pivotally joined to the housing and the spool cover includes means for maintaining the spool on the spindle.

3. The apparatus of claim 1 in which the means for retaining hair in the detent is a cover joined to the housing and spaced apart from the end of the spindle.

4. The apparatus of claim 2 in which the spool cover is spaced apart from the end of the spindle.

5. The apparatus of claim 3 in which the spindle further comprises means for adjusting the spacing between the end of the spindle and the cover.

6. The apparatus of claim 3 in which the spindle further comprises a threaded cap for adjusting the spacing between the end of the spindle and the cover.

7. The apparatus of claim 1 in which the housing defines an internal space and the means for rotating the spindle is disposed at least partially in the internal space.

8. The apparatus of claim 1 in which the housing defines an internal space and the means for rotating the spindle is disposed at least partially in the internal space and comprises:

a battery-powered motor having a rotating shaft;

a gear mesh for transmitting rotation of the motor shaft to the spindle; and switch means for activating the battery-powered motor.

9. The apparatus of claim 1 in which the housing defines an internal space and the means for rotating the spindle is disposed at least partially in the internal space and comprises:

a battery-powered motor having a rotating shaft;

a worm gear fixed to the rotating shaft;

a worm gear follower meshed with the worm gear;

a spur gear fixed coaxially to the worm gear follower;

an idler gear meshed with the spur gear; and a drum gear meshed with the idler gear and fixed coaxially to the spindle.

10. A device for wrapping hair with a cord, comprising:

a housing defining a spool chamber and an internal space;

a spindle disposed in the spool chamber and rotatably joined to the housing, the spindle defining a spindle bore for receiving cord and hair, and having an end defining cord retaining detents;

a spool for receiving and dispensing cord, the spool defining a spool bore through which the spindle is disposed;

a spool cover pivotally connected to the housing for maintaining the spool in the spool chamber and cord in the detent of the spindle;

a motor disposed in the internal space and having a rotating shaft; and a gear mesh disposed at least partially in the internal space for transmitting rotary motion from the motor shaft to the spindle;

whereby cord is dispensed from the spool through a spindle detent and through the spindle bore, hair is disposed in the spindle bore, and the motor is activated to rotate the spindle and wrap the hair with cord being dispensed from the spool through the spindle detent.

11. The apparatus of claim 10 in which the spool cover is spaced apart from the end of the spindle.

12. The apparatus of claim 10 in which the spindle further comprises means for adjusting the spacing between the end of the spindle and the spool cover.

13. The apparatus of claim 10 in which the spindle further comprises a thread cap for adjusting the spacing between the end of the spindle and the spool cover.

14. The device of claim 10 in which the gear mesh comprises:

a worm gear fixed to the rotating shaft of the motor;

a worm gear follower meshed with the worm gear;

a spur gear fixed coaxially to the worm gear follower;

an idler gear meshed with the spur gear; and a drum gear meshed with the idler gear and fixed coaxially to the spindle.

15. The device of claim 10, and further comprising:

a bifurcated hair-feeding tool for retaining and feeding hair and cord through the spindle bore.

16. A device for wrapping hair with a cord, comprising:

a housing defining a spool chamber and an internal space;

a spindle disposed in the spool chamber and rotatably joined to the housing, the spindle defining a spindle bore for receiving cord and hair;

a spool for receiving and dispensing cord, the spool defining a spool bore through which the spindle is disposed;

means for applying variable friction between the spool and the spindle to adjust tension in the cord;

a motor disposed in the internal space and having a rotating shaft; and a gear mesh disposed at least partially in the internal space for transmitting rotatory motion from the motor to the spindle.

* * * * *